United States Patent [19]

Ferguson

[11] Patent Number: 4,955,520

[45] Date of Patent: Sep. 11, 1990

[54] WEB FEED DEVICE HAVING AN IMPROVED LID MECHANISM

[75] Inventor: Gregory A. Ferguson, New Bedford, Mass.

[73] Assignee: Precision Handling Devices, Inc., Fall River, Mass.

[21] Appl. No.: 328,424

[22] Filed: Mar. 24, 1989

[51] Int. Cl.[5] ..... B65H 20/20

[52] U.S. Cl. ..... 226/74; 400/616.1

[58] Field of Search ..... 226/74, 75; 400/616.1, 400/616.2; 220/335; 16/250, 251, 341, 303, 306, 324

[56] References Cited

U.S. PATENT DOCUMENTS

| | | | |
|---|---|---|---|
| 1,494,165 | 7/1922 | Hall | 220/335 |
| 2,171,003 | 8/1939 | Malon | 197/133 |
| 2,179,150 | 11/1939 | Hageman | 271/2.1 |
| 3,317,102 | 5/1967 | Lizotte | 226/75 |
| 3,422,310 | 6/1947 | Nemeth | 271/2.3 |
| 3,825,162 | 7/1974 | Hubbard | 226/74 |
| 3,888,386 | 6/1975 | Svensson | 220/335 X |
| 3,930,594 | 1/1976 | Jüngmann | 16/341 X |
| 4,114,236 | 9/1978 | Vandervort | 220/335 X |
| 4,193,163 | 3/1980 | Lauteneblager | 16/250 |
| 4,199,091 | 4/1980 | Hubbard | 26/74 |
| 4,611,737 | 9/1986 | Hubbard | 226/74 |
| 4,614,287 | 9/1986 | Ueno | 226/74 |
| 4,650,358 | 3/1987 | Lohrmann | 400/61.62 |
| 4,706,861 | 11/1987 | Kerivan | 226/74 |
| 4,735,352 | 4/1988 | Ueno | 226/74 |
| 4,761,852 | 8/1988 | Sauber | 16/251 X |
| 4,765,523 | 8/1988 | Ferguson | 226/74 |
| 4,790,467 | 12/1988 | Rex et al. | 226/74 |
| 4,817,842 | 4/1989 | Wilson, III | 226/74 |

FOREIGN PATENT DOCUMENTS

| | | | |
|---|---|---|---|
| 0063230 | 10/1982 | European Pat. Off. | 220/335 |

*Primary Examiner*—Daniel P. Stodola
*Assistant Examiner*—Paul Thomas Bowen
*Attorney, Agent, or Firm*—Martin LuKacher

[57] ABSTRACT

An improved lid mechanism for a web feed devices such as tractors for feeding perforated paper webs in printers, copiers and the like, wherein pins on which the lid is pivotally mounted for movement between open and closed position are unloaded (do not have any force or bias applied thereto) when the lid is in its open and closed position. The lid, when closed, covers the paper and is then spaced by a gap from the surface of a frame along which the paper is fed by a pin drive such as a belt having pins which extend into perforations of the paper. A depending leg of the lid has a block with surfaces disposed at an angled to each other. These surfaces extend from a corner of the block. One of these surfaces is preferably perpendicular to the surface of the lid which defines the gap. The other of these surfaces defines the position of the lid in its open position. These surfaces bear against the outer wall of the side plate of the frame of the device (the tractor) and are biased thereagainst by a flat spring mounted on the side plate. This spring bears against surfaces of the block opposite to the surfaces which bear against the outer side wall. The location of the lower surface of the lid and the size of the gap is defined by a pin and slot hinge arrangement. The slot is longer than the stroke of the pin which is executed as the lid moves between its open and closed position. Accordingly in both the open and closed position the block is under compression and the pin is unloaded. The lid may be molded and is an integral body of plastic.

22 Claims, 4 Drawing Sheets

WEB FEED DEVICE HAVING AN IMPROVED LID MECHANISM

DESCRIPTION

The present invention relates to web feed apparatus and particularly to improved lid mechanism for web feed apparatus.

The present invention is especially suitable for providing a lid mechanism in a tractor which feeds perforated paper webs in printers, copiers and the like. The invention is also useful in other web feed and guidance devices such as pin wheels, guide rollers, pulleys and the like.

The lid mechanism of web feed devices, particularly tractors (sometimes called form or document feed tractors) presents a significant design problem because of the cost of the springs and pins of the mechanism and the assembly thereof. The problem is exacerbated because it is important to provide a precise gap between the bottom of the lid and the surfaces of the tractor through which gap the paper is fed. The precise gap spacing is necessary in order to mitigate against jamming of the paper as the pins enter and leave the perforations. The importance of a precise lid gap is discussed in detail in U.S. Pat. No. 4,611,737 issued Sept. 16, 1986 to John B. Hubbard and Leo J. Kerivan. In most lid mechanisms the spring is connected to the lid at a distance from the pivot axis of the lid thereby reducing the force on the lid which maintains it o the paper. Also lid rests are used against which the lower surface of the lid, which defines the gap, bears. The gap can vary in size if the pivot moves as can occur when the hinge pin bends. In conventional lid mechanism designs, the hinge pin is always loaded; the force of the spring being applied thereto. Thus dynamic factors such as material strength bending deflections and homogeneity of the parts of the lid come into play and affect the location and size of the lid gap. Accordingly, steel hinge pins and dense high strength plastics have been needed in tractor and other feeding devices where accuracy of lid gap location and spacing is a requirement.

It is desirable to be able to avoid the use of steel hinge pins and even to mold the lid including the hinge pins from plastic and especially low cost, low strength plastics (plastic having low modulus of elasticity) such as polypropolene and acetal plastics.

Various lid mechanisms for document feed tractors and other feed devices have been proposed. The most widely used mechanisms are of the type shown in the above cited U.S. Pat. No. 4,611,737 involving coil springs mounted off center from pivot pins. See also U.S. Pat. No. 4,706,861 issued to Leo J. Kerivan on Nov. 17, 1987 which also discusses the gap spacing problem and an earlier embodiment of this type of lid mechanism which is shown in U.S. Pat. No. 3,825,162 issued to Leo J. Hubbard on July 23, 1974.

Attempts to simplify the design of tractor lid mechanisms use spring pivots (see U.S. Pat. Nos. 4,614,287 issued Sept. 30, 1986 and 4,735,352 issued Apr. 5, 1988) or torsion springs (see U.S. Pat. No. 4,650,358 issued Mar. 17, 1987). Both in the case of the spring pivot and torsion spring pivot design the hinge Pins provided by these spring pivots are under load and subject to the dynamic effects which cause lid location and lid gap variations during operation of the tractor. The other lid mechanism designs involving spring bias pivots use snap-over-center springs which load the pivots. The designs therefore are subject to the same inaccuracies as the lid mechanisms described in the more recent patents discussed above and are also costly to fabricate. See Mabon, U. S. Pat. No. 2,171,003, Aug. 29, 1939; Hageman, U.S. Pat. No. 2,179,150, Nov. 7, 1939; Nemeth, U.S. Pat. No. 2,422,310, June 17, 1947 and Lizotte, U.S. Pat. No. 3,317,102, May 2, 1967.

Accordingly, it is the principal object of this invention to provide an improved web feed device having a lid mechanism wherein the foregoing problems and disadvantages are substantially obviated.

It is a further object of the present invention to provide an improved lid mechanism for a document feed tractor or other web feed device which is not subject to dynamic effects which may cause the location of the surface of the lid under which the paper passes and the gap between that surface and the surface of the tractor or other web feed device over which the paper travels to vary during operation (when the lid is either down and closed, or open and up).

It is a still further object of the present invention to provide an improved lid mechanism which is adapted to be hinged on a pin or pins so as to be movable between open and closed positions, wherein the hinge pin(s) remains unloaded during operation and therefore is not subject to bending and other dynamic effects.

It is a still further object of the present invention to Provide an improved tractor or other web feed device which can be fabricated at lower cost than heretofore by means of the use of a lid which is an integrally molded body of plastic including, if desired the hinge pins thereof.

Briefly described, a lid mechanism for a web feed device in accordance with the invention utilizes a lid member with a block extending therefrom. The block has side faces which are angularly disposed with respect to each other and which are adapted to bear against a wall of the frame of the web feed device. A hinge pivotally connects the lid and the wall so that the lid can move between an open position where one of the side faces bears against the wall and the closed position where the other of the side faces bears against the wall. A spring, preferably a flat spring mounted on the wall bears against the block and biases the block against the wall applying compressive forces to the block without loading the hinge. The hinge has a pin and slot arrangement, the slot being longer than the stroke (the distance over which the lid and the hinge move as the lid moves between open and closed position. Accordingly, when either in open or closed position, the hinge is relieved of load due to the bias on the block. The pin and slot provide guidance for the lid during the stroke and sets the lid gap. The hinge pin(s) is not loaded when the lid is down and even also when the lid is up. However, compressive forces are applied against the block so that it is accurately held and indexed against the surface of the wall thereby establishing, by static, rather than dynamic position holding, the parallelism and width of the lid gap.

The foregoing and other objects, features and advantages of the invention as well as presently preferred embodiments thereof will become more apparent from a reading of the following description in connection with the accompanying drawings in which.

Figure 1:
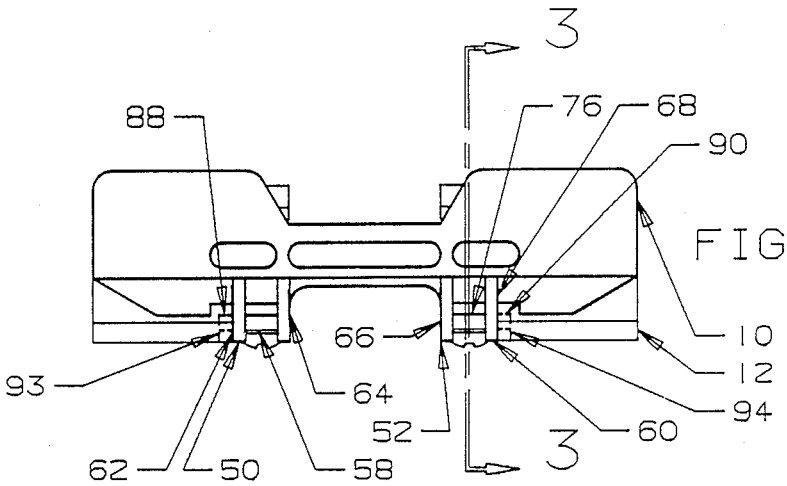
FIG. 1 is a top view of a tractor embodying the invention.
Figure 2:
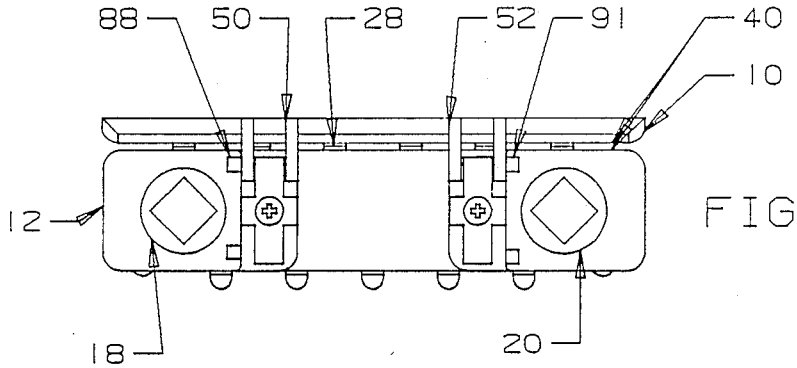
FIG. 2 is an elevational view from the rear or outside of the tractor shown in FIG. 1.

Referring to FIGS. 1 through 5, there is shown a tractor having a lid 10 and a frame 12 made up of an inside side plate 14 and an outside side plate 16. A pair of sprockets or drive pulleys 18 and 20 (one of which may function as an idler pulley) are journalled in the frame in holes 22 and 24 in the outside side plate 16 and 22A and 24A in the inside side plate 14. A belt 26 having pins 28 which enter into perforations in the paper 31 is mounted on the frame and driven by the sprockets 18 and 20. The design of the belt may be similar to that described in the above referenced U.S. Pat. Nos. 3,825,162, 4,611,737 and 4,706,861. Also supports 30 and 32 for the belt between the sprockets 18 and 20 are provided so as to guide the belt in accordance with the principles of tractor belt guidance described in the above-referenced U.S. Pat. No. 3,825,162. Top surfaces 34 and 36 of the side plates 14 and 16 provide frame surfaces along which the web travels. The lid 10 has a lower surface 38 which is spaced parallel to the surface of the frame defined by the top surfaces 34 and 36. This spacing is the lid gap 40 through which the paper 31 travels.

It will be apparent as the description proceeds that the tractor is entirely reversible. The lid 10 may be mounted to face surfaces 34A and 36A on the bottom of the frame. Then the lid gap will be between these surfaces and the lower surface of the lid. A pair of lids may be used one adjacent to the top and another adjacent to the bottom surface. Also the lids may be mounted on the inside side plate 14. Only a single lid mounted on the outside side frame is shown to simplify the illustration and explanation of the invention.

As the belt is driven by at least one of the sprockets 18 and 20 with the grooves 42 thereof engaging the lugs 44 in the belts, the paper 31 is fed through the gap 40 and is maintained in place on the belt and on the guide surfaces 34 and 36 by the lid 10.

The lid is "L" shaped and has a longer leg 46 and a shorter leg 48. The shorter leg is made up of two parts 50 and 52 which are disposed in the inside side plate 16 against outer walls 54 and 56 of the side plate 16. The parts 50 and 52 of this leg 48, which are so disposed, are blocks 58 and 60 having flanges, 62 and 64 on the opPosite sides of the block 58 and 66 and 68 on the opposite sides of the block 60. The blocks themselves are polygons. The shapes are identical and the block 60 is illustrated in detail in cross section in FIGS. 3 and 4. Adjacent faces 70 and 72 of these polygons, which are adjacent to a corner 74 of the polygon, bear against the outer wall surface 56 when the lid is in closed position (down) and when the lid is in the open position (up). The angle between the faces 72 and 70 defines the amount of opening, i.e. the angle between the lower surface of the lid 10 and the upper surface 34, 36 of the frame 12. The distance of the opening is sufficient in order to allow the paper to be placed on the pins 28 and to be removed therefrom.

Figure 6:
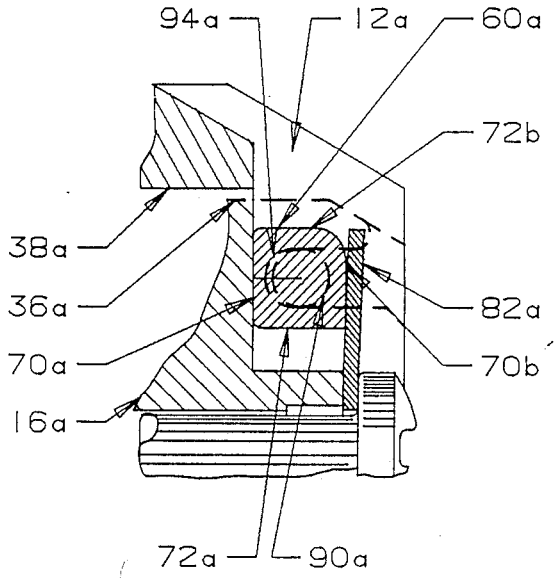
FIG. 6 is a fragmentary sectional view of a lid mechanism in accordance with another embodiment of the invention which view is similar to FIG. 3 (the lid being closed).
Figure 3:
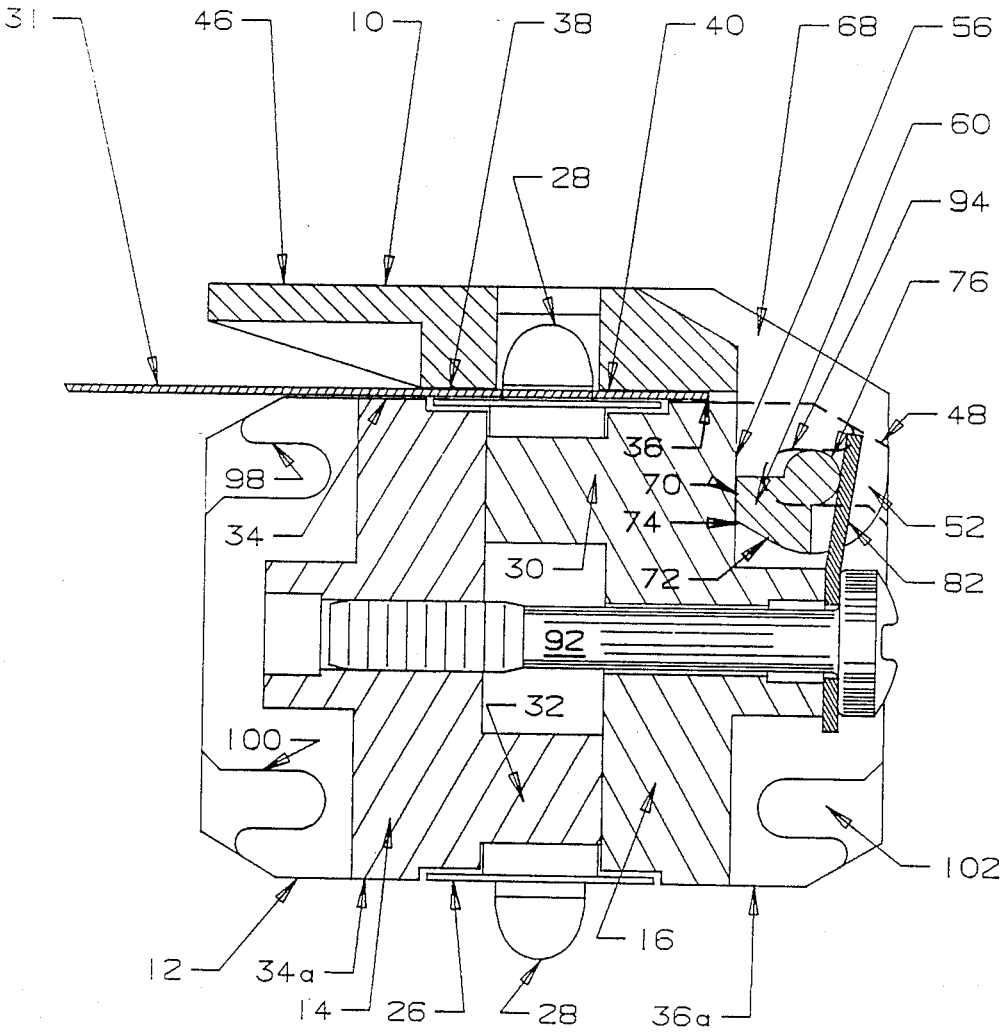
FIG. 3 is a sectional view, the section being taken along the line 3—3 in FIG. 1 when the lid of the tractor is in closed position.
Figure 4:
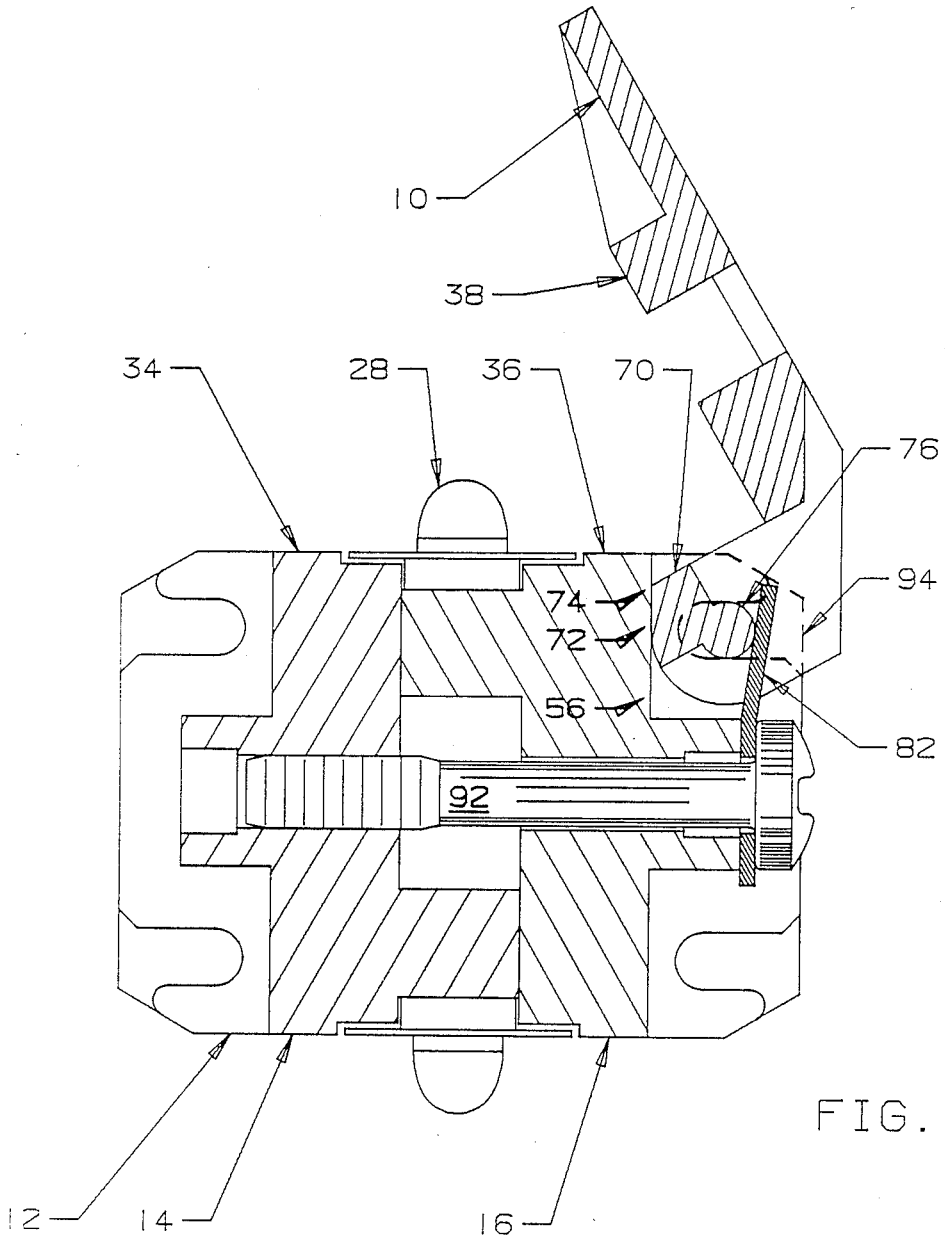
FIG. 4 is a view similar to FIG. 3 but with the lid in open position.
Figure 5:
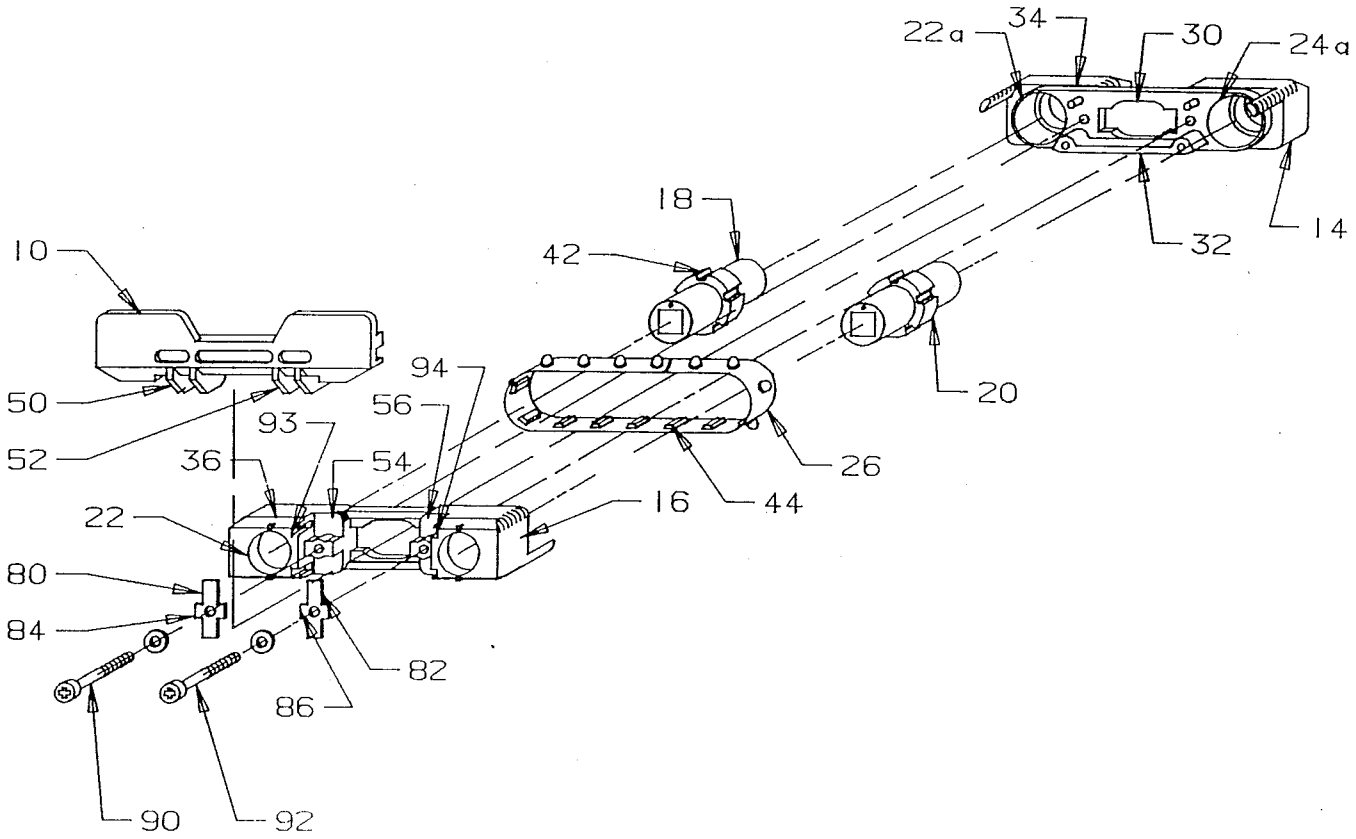
FIG. 5 is an exploded view of the tractor shown in FIGS. 1 through 4.

In the embodiment shown in FIG. 6 there is also a block 60*a* which is generally rectangular (square) and has adjacent faces 70*a* and 72*a* which are at 90° to each other. Then the lower surface 38*a* of the lid 12*a* is spaced from the frame surface (only part of which 36*a* is shown) and these surfaces are 90° or perpendicular to each other when the lid is open.

The opposite to the surfaces 70 and 72 of the block 60 there is a surface 76 which is defined by a cylindrical body (circular in cross section) at the corner of the block 60 opposite to the corner 74 between the bearing surfaces 70 and 72 of the block which bear against the outer wall surface 56 of the side plate 16. This circular surface 76 has portions which oppose these bearing surfaces 70 and 72. These opposing surfaces may be surfaces of the rectangular body 60*a* (FIG. 6) which are opposite the bearing surfaces 70*a* and 72*a*. These are the surfaces shown at 70*b* and 72*b* in FIG. 6.

Flat cantilever springs 80 and 82, which may have cross strips 84 and 86, are connected by bolts 90 and 92 to the frame 12. These bolts 90 and 92 also serve to assemble the frame and the tractor, since the springs also hold the lid 10 in the assembly, as will become more apparent as the description proceeds. It will be appreciated that the springs may be molded as an integral part of the side plates and the tractor assembled by a snap together fitting or welding. Snap together fittings, using the principles described in U.S. Pat. No. 4,199,091 issued to Leo J. Hubbard on Apr. 22, 1980, may be used. The springs bias the blocks and cause the surface 70 (when the lid is down in closed position) and the surface 72 (when the lid is up and in open position) to bear against the outer wall 56 of the side plate 16. The surface 70, is preferably perpendicular to the lower surface 38 of the lid 10. Since the outer wall 56 is perpendicular to the guide surfaces 34 and 36 of the frame 12 the lower surface 38 of the lid will be parallel to the frame guide surface 34, 34.

The gap dimensions (the width of the gap 40) is determined by a hinge arrangement. This hinge arrangement consists of pins 88 and 91 (as shown in FIG. 1), which are extensions of the circular cross section portions 76 of the blocks 58 and 60, as best shown in FIG. 1. There are grooves 93 and 94 into which these pins 88 and 91 extend. There are similar grooves 98, 100 and 102 in the inside side plate 14 and outside side plate 16. Accordingly, the lid can be fit therein and the spring 82 reversed and the bolts 90 and 92 reversed so as to locate the lid in the position illustrated or in the other 3 positions defined by the grooves 98, 100 and 102 on the frame 12.

It is an important feature of this invention that the grooves (e.g., 94) are longer than the travel or stroke of the lid (the distance the lid moves back and forth as guided in the groove). Then there is no loading (no forces are applied to the hinge pins) when the lid is in its down or in its up position. The lid is then statically positioned and dynamic effects such as the bending of the pin are eliminated. The pins may be molded integrally with the lids out of the same low modulus, low cost plastics such as the polypropolene and acetal plastics. The blocks 60 and 58 are in compression and the walls 56 and the surfaces 70 and 72 accurately define the location of the lid and the parallelism of the surfaces which define the lid gap.

It will be appreciated that the groove may be provided in the blocks 58 and 60 and the pins may be provided in the side frame 16. The pins will then extend into the blocks 58 and 60. The construction shown in the drawings is more readily implemented by molding and is preferred.

FIG. 6 was discussed in part above. It will be appreciated that it provides a lid mechanism operating in a manner similar to that of the lid mechanism shown in FIGS. 1 through 5 and like parts are indicated by like reference numerals with the postscript "a" except where otherwise indicated.

From the foregoing description it will be apparent that there has been provided an improved lid mechanism for a tractor or other web feeding or web guidance device. Variations and modifications in the herein described device, within the scope of the invention will undoubtedly suggest themselves to those skilled in the art. Accordingly the foregoing description should be taken as illustrative and not in a limiting sense.

I claim:

1. A lid mechanism for a web feed device having a frame which has a wall, which lid mechanism comprises a lid member, a block extending from said lid member, said block having side faces angularly disposed to each other, a hinge pivotally connecting said lid and said wall for movement between open position where one of said side faces bears against said wall and closed position where another of said side faces bears against said wall, a spring mounted on said wall and bearing against said block to bias said faces of said block against said wall thereby applying compressive forces against said block, said hinge having parts extending from said wall and from said block including a portion of said hinge which is connected to said block, means providing for the movement of said portion of said hinge towards and away from said wall to a position where it is relieved of load, due to the bias from said spring on said block, when said lid is in said open position and when said lid is in said closed position.

2. The method according to claim 1 wherein said mechanism has a frame defining a surface along which said web is fed, said hinge being defined by a slot on a pin spaced a predetermined distance from a surface of said lid which is disposed opposite to said surface of said frame to define a gap precisely spacing said lid surface on said frame surface to which said web is fed.

3. The mechanism according to claim 1 wherein the one of said faces of said block which bears against said wall when said lid is closed is at such an angle to said lid surface to set said lid surface and said frame surface parallel to each other when said lid is closed.

4. The lid mechanism according to claim 1 wherein said hinge has a pivot which is defined by a slot and a pin, one of said wall and block having said slot and the other of said wall and slot having said pin, said slot having sides along which said pin travels, said slot being sufficiently long in a direction along said sides thereof such that said pin and slot are mechanically decoupled and said pin is unloaded by force due to said spring when said faces bear against said wall.

5. The lid mechanism according to claim 4 wherein said block is a polygon having said faces extending from one edge thereof, said block having surface portions opposite to each of said faces, said spring being a flat spring cantilever mounted on said wall and having an end which bears against said surface portions.

6. The lid mechanism according to claim 5 wherein said polygon is generally rectangular and has pairs of opposite side surfaces one of which pairs defines said one face and one of said surface portions and the other of which pairs defines said other face and said other of said surface portions.

7. The lid mechanism according to claim 5 wherein said block and said lid are an integral body.

8. The lid mechanism according to claim 7 wherein said integral body is molded from plastic.

9. The lid mechanism according to claim 8 wherein said plastic is selected from the group consisting of polypropolene and acetal plastic.

10. The lid mechanism according to claim 5 wherein said wall has said slot therein, said pin extending sidewise from said block into said slot.

11. The lid mechanism according to claim 10 wherein said lid has a pair of said blocks spaced from each other, a pair of said springs mounted on said wall, each said spring biasing a different one of said blocks, a pair of pins extending in opposite directions each out of the side of a different one of said blocks, and said wall having a pair of said slots spaced from each other a distance corresponding to the spacing of said pins and into which said pins extend.

12. In a tractor for feeding perforated paper having a belt from which pins extend into the perforations in the paper, which belt is entrained around at least one drive sprocket rotatably disposed in a frame having at least one side plate, and a lid movably mounted on said frame for movement from open position to enable location of the paper on the pins to closed position covering said paper, said lid having a lower surface spaced by a gap from a surface of said frame along which a said paper is fed by said belt, an improved mechanism for mounting said lid on said frame which comprises a block extending from said lid to a location adjacent to an outer wall surface of said side plate, said block having first and second surfaces which are angularly displaced from each other, said first face being at such an angle to said lower surface of said lid to locate said lower surface parallel to the surface of said frame along which said paper is fed when said first face bears against said outer wall surface of said side plate, said second face being at an angle to said lower surface of said lid to dispose said lid away from said frame a sufficient distance to enable location of said paper on the pins, said block having a third surface with portions disposed opposite to said first and second faces, a flat spring cantilever mounted on said wall and bearing against said third surface so as to bias that first surface against said outer wall surface of said side plate when said lid is closed and to bias said second surface against said side plate when said lid is open, a hinge pin and slot arrangement pivotally connecting said lid to said side plate, one of said hinge pin and slot being disposed on said lid and the other of said hinge pin and slot being disposed on said side plate, said hinge pin and slot being relatively moveable with respect to each other as said lid is pivoted between open and closed positions, and said slot being longer than the stroke of said relative movement of said pin and slot with respect to each other between said open and closed positions such that said block is placed in compression while said pin is free of load, due to said spring, when said first and second faces bear against said outer wall of said side plate.

13. The improved mechanism according to claim 12 wherein the one of said pin and slot on said lid is spaced from said lower surface a sufficient distance to define said gap when said lid is in closed position.

14. The improved mechanism according to claim 12 wherein said first face and second face are adjacent sides of said block.

15. The improved mechanism according to claim 14 wherein said third portion defines the corner of said body opposite to another corner thereof which is defined by said first and second faces.

16. The improved mechanism according to claim 14 wherein said block is generally rectangular in cross-section along a plane perpendicular to a pivot axis defined by said pin, said first face and said second face being adjacent sides of said rectangular cross-section and said third surface being defined by the size of said rectangular cross-section opposite to said first and second faces, said spring bearing upon different ones of said opposite sides in the open and close position of said lid.

17. The improve mechanism according to claim 12 wherein said first face is perpendicular to said lower surface of said lid.

18. The improved mechanism according to claim 12 wherein said third surface defines at least a portion of a circle along the periphery thereof.

19. The improved mechanism according to claim 18 wherein the axis of said pin extends through the center of said circle.

20. The improved mechanism according to claim 12 wherein said lid is "L" shaped and having longer and shorter legs one of which defines said lower surface, said block defining said shorter leg, a pair of said hinge pins extending from said block, a pair of said slots in said side plate which received said hinge pins.

21. The improved mechanism according to claim 20 wherein said lid in its entirety, including both said legs and said pins, is molded from a body of plastic.

22. The improved mechanism according to claim 20 wherein said shorter leg is defined by a pair of said blocks, a pair of said hinge pins each extending from a different one of said blocks, and a pair of said slots into which different ones of said hinge pins extend, said slots being disposed in said side plate.

* * * * *